US006310552B1

(12) United States Patent
Stumberg et al.

(10) Patent No.: US 6,310,552 B1
(45) Date of Patent: Oct. 30, 2001

(54) INTEGRATED FIREFIGHTER SAFETY MONITORING AND ALARM SYSTEM

(75) Inventors: L. Herbert Stumberg, Bexar County, TX (US); James A. Fulton, West Grove, PA (US)

(73) Assignee: North-South Corporation, San Antonio, TX (US)

( * ) Notice: Subject to any disclaimer, the term of this patent is extended or adjusted under 35 U.S.C. 154(b) by 0 days.

(21) Appl. No.: 09/639,184

(22) Filed: Aug. 15, 2000

Related U.S. Application Data

(63) Continuation of application No. 09/289,263, filed on Apr. 9, 1999, which is a continuation of application No. 08/971,532, filed on Nov. 17, 1997, now Pat. No. 5,910,771, which is a continuation of application No. 08/474,516, filed on Jun. 7, 1995, now Pat. No. 5,689,234, which is a continuation of application No. 08/348,762, filed on Dec. 2, 1994, now abandoned, which is a continuation of application No. 08/200,908, filed on Feb. 22, 1994, now abandoned, which is a continuation of application No. 08/079,670, filed on Jun. 18, 1993, now abandoned, which is a continuation of application No. 07/963,098, filed on Oct. 19, 1992, now abandoned, which is a continuation of application No. 07/741,269, filed on Aug. 6, 1991, now Pat. No. 5,157,378.

(51) Int. Cl.[7] ..... G08B 23/00

(52) U.S. Cl. ..... 340/573.1; 340/521; 340/522; 340/540; 340/626; 2/8; 2/69; 2/94

(58) Field of Search ..... 340/573.1, 521, 340/586, 626, 522, 584, 589, 540; 2/69, 81, 94, 8; 200/61.03

(56) References Cited

U.S. PATENT DOCUMENTS

| | | | |
|---|---|---|---|
| 4,468,656 | 8/1984 | Clifford et al. | 340/539 |
| 4,718,776 | 1/1988 | Gilland et al. | 374/170 |

(List continued on next page.)

FOREIGN PATENT DOCUMENTS

| | | |
|---|---|---|
| 0324259A2 | 12/1988 | (EP) . |
| 0551496B1 | 1/1998 | (EP) . |
| 2141825A | 1/1985 | (GB) . |
| WO 93/03465 | 2/1993 | (WO) . |

OTHER PUBLICATIONS

Copy of Complaint—Air Measurement Technologies, Inc., North–South Corp. v. Interspiro, Inc. and InterspiroAB, Civil Action No. SA–01–CA0135, filed in U.S. Disctrict Court, Western District of Texas, San Antonio, Texas on Feb. 15, 2001, citing U.S. Patent No. 5,910,771.

Copy of Compliant filed in U.S. District Court, Western District of Texas, San Antonio, Texas on Dec. 28, 2000, citing U.S. Patent No. 5,910,771 (Civil Action No. SA–00–CA–1562HG).

Copy of Complaint filed in U.S. District Court, Western District of Texas, San Antonio, Texas on Apr. 12, 2000, citing U.S. Patent No. 5,910,771 (Civil Action No. SA–00–Ca–0427HG).

Brochure from Orca Industries, Inc. (1991).

*Primary Examiner*—Daniel J. Wu
*Assistant Examiner*—Toan Pham
(74) *Attorney, Agent, or Firm*—Akin, Gump, Strauss, Hauer & Feld, L.L.P.

(57) ABSTRACT

A system which allows the firefighter to monitor a variety of safety related parameters during firefighting activities through audible and/or visual means. The system of the present invention monitors the pressure in the firefighter's breathing system and also monitors ambient temperature and motion of the firefighter. An audible alarm is activated to indicate a potential emergency situation relating to low remaining air time, impending thermal breakthrough or lack of motion of the firefighter.

16 Claims, 7 Drawing Sheets

U.S. PATENT DOCUMENTS

| | | | | |
|---|---|---|---|---|
| 4,800,373 | | 1/1989 | Mayz | 340/626 |
| 4,884,067 | | 11/1989 | Nordholm et al. | 340/689 |
| 4,906,972 | | 3/1990 | Spencer | 340/539 |
| 4,914,422 | | 4/1990 | Rosenfield et al. | 340/573.1 |
| 5,001,783 | | 3/1991 | Grilliot et al. | 2/81 |
| 5,045,839 | | 9/1991 | Ellis et al. | 340/539 |
| 5,097,826 | | 3/1992 | Gray et al. | 128/204.18 |
| 5,157,378 | | 10/1992 | Stumberg et al. | 340/521 |
| 5,461,934 | * | 10/1995 | Budd | 73/864.52 |
| 5,640,148 | * | 6/1997 | Lewis et al. | 340/573.1 |
| 5,689,234 | | 11/1997 | Stumberg et al. | 340/521 |
| 5,781,118 | * | 7/1998 | Wise et al. | 340/632 |
| 5,832,916 | * | 11/1998 | Lundberg | 128/202.22 |
| 5,910,771 | | 6/1999 | Stumberg et al. | 340/573.1 |
| 5,949,337 | * | 9/1999 | Campman | 340/573.1 |
| 5,990,793 | * | 11/1999 | Bieback | 340/573.1 |
| 6,118,382 | * | 9/2000 | Hibbs et al. | 340/586 |
| 6,144,302 | * | 11/2000 | Cotty, Jr. et al. | 340/573.1 |
| 6,201,475 | * | 3/2001 | Stumberg et al. | 340/573.1 |

* cited by examiner

INTEGRATED FIREFIGHTER SAFETY MONITORING AND ALARM SYSTEM

This is a continuation of copending application Ser. No. 09/289,263 filed on Apr. 9, 1999 by Stumberg, et al., entitled "INTEGRATED FIREFIGHTER SAEFTY MONITORING AND ALARM SYSTEM," which is a continuation of prior application Ser. No. 08/971,532, filed Nov. 17, 1997, now U.S. Pat. No. 5,910,771 issued Jun. 8, 1999, which is a continuation of prior application Ser. No. 08/474,516, filed Jun. 7, 1995, now U.S. Pat. No. 5,689,234 issued Nov. 18, 1997, which is a continuation of application Ser. No. 08/348,762 filed on Dec. 2, 1994; now abandoned which is a continuation of application Ser. No. 08/200,908 filed on Feb. 22, 1994; now abandoned which is a continuation of application Ser. No. 08/079,670 filed on Jun. 18, 1993; now abandoned which is a continuation of application Ser. No. 07/963,098 filed on Oct. 19, 1992; now abandoned which is a continuation of application Ser. No. 07/741,269 filed on Aug. 6, 1991, now U.S. Pat. No. 5,157,378.

FIELD OF THE INVENTION

The present invention relates to person monitoring and alarm systems. More particularly, the present invention provides an automated alarm system for monitoring a plurality of parameters during firefighting activities and providing appropriate alarms to a firefighter to inform him of a dangerous situation.

BACKGROUND OF THE INVENTION

Over the past few years, firefighters have been using various types of systems to ensure their safety while working alone in dangerous situations. For example, firefighters have used a personal alert safety system which is activated manually and has a "panic button" type of switch capable of activating an electronic whistle. Further, the personal alert safety system can sense when its wearer has not moved for a period of time, such as thirty (30) seconds, thereby causing the system's alarm to automatically activate. However, a common problem with these types of personal alert safety systems is that the firefighter frequently forgets to turn them on. That is, in the hustle of jumping off the firetruck, donning gear, assessing the fire situation and taking orders, firefighters will often run into the fire and neglect to activate the safety system.

Firefighters have also utilized temperature alarms which activate an audible alarm whenever the air temperature rises above a preset limit. Due to the efficient insulation of the firefighter garments, firefighters have little feeling for the temperature of the air around them. The heat may actually accumulate in the garment and finally "break through" with no advance warning to the firefighter. Firefighters have also utilized pressure gauges for indicating the pressure within their air cylinders. However, simply providing the air pressure does not communicate to the firefighter the firefighter's remaining air time based upon his or her activity.

As such, prior systems for utilization by firefighters in dangerous firefighting circumstances have numerous limitations.

DETAILED DESCRIPTION OF THE PREFERRED EMBODIMENTS

Figure 1:
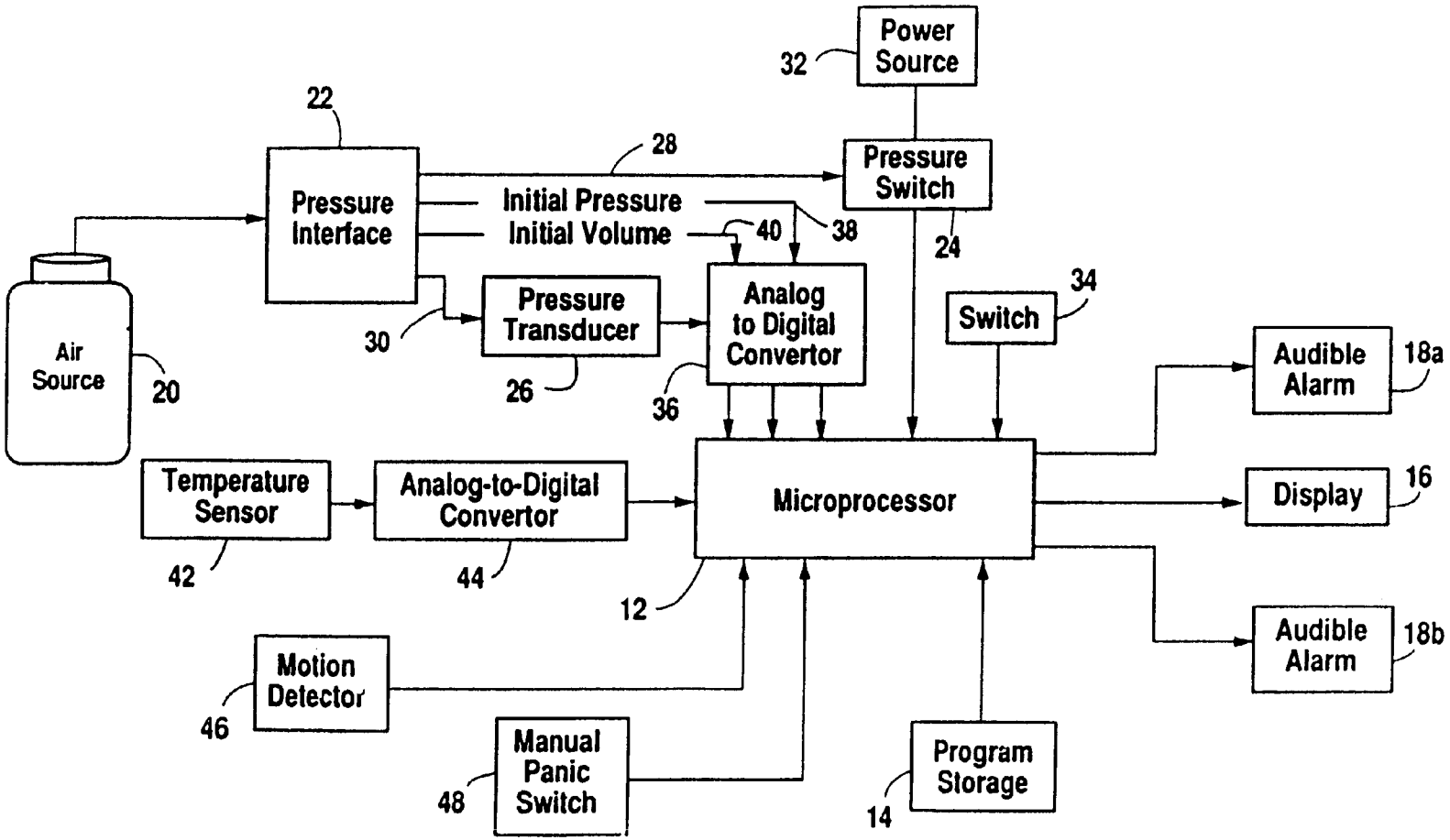
FIG. 1. is a schematic block diagram of the system components of the firefighter's computer system of the present invention.

FIG. 1 is a schematic illustration of the system components of the firefighter system of the present invention. The system is adapted to receive a plurality of input signals relating to the following parameters: 1) pressure of the air reservoir; 2) the resulting temperature of the ambient environment and the temperature gradient within the firefighter's suit; and 3) the physical activity of the firefighter (i.e., motion or lack of motion). The information relating to these parameters is processed by a microprocessor and appropriate messages are displayed or audible alarms are activated. In addition, the firefighter may activate an audible alarm by pressing a manual panic switch.

Referring to FIG. 1, a plurality of transducers are shown for providing data input signals to a microprocessor 12. The microprocessor 12 processes the data signals in accordance with a plurality of algorithms, discussed in greater detail below, contained in program storage 14. The processor displays appropriate messages on a display 16, which may be in the form of liquid crystal display (LCD). The processor also activates audible alarms 18*a* and 18*b* to indicate potential or actual emergency situations.

Information relating to the air source 20 is provided via a pressure interface 22 which provides pneumatic pressure signals to pressure switch 24 and pressure transducer 26, via pneumatic lines 28 and 30, respectively. Upon activation by pneumatic pressure, pressure switch 24 allows power to flow from power source 32 to activate the microprocessor 12. The user can turn the system off by pressing switch 34 which deactivates the microprocessor 12. The pressure transducer 26 receives a pneumatic signal from the pressure interface 22 and produces an analog voltage signal corresponding to the pressure in the air source 20. The analog-to-digital converter 36 converts the analog signal from the transducer 26 into a digital signal which can be accepted by the microprocessor 12. The pressure interface 22 also provides information relating to the initial tank pressure and initial tank volume which is provided to the analog-to-digital converter 36 by signal lines 38 and 40, respectively.

Information regarding temperature in the ambient environment is provided by temperature sensor 42 which provides an analog signal to be converted by analog-to-digital converter 44 into a digital signal for processing by the microprocessor 12. The temperature information can be processed, using algorithms discussed below, to anticipate "break through" of excess thermal energy through the firefighter's suit.

A motion detector 46 provides an input signal indicating whether the firefighter is moving. The microprocessor samples the motion detector periodically to determine whether the firefighter is physically inactive for a predetermined time period, e.g. 20. seconds, and activates audible alarm 18*a* if this time period is exceeded. A second audible alarm 18*b* is activated if the inactivity period exceeds a second predetermined time limit, e.g. 30 seconds.

The manual panic switch 48 can be activated by the user to provide a data signal to the microprocessor indicating an emergency situation.

Figure 2A:
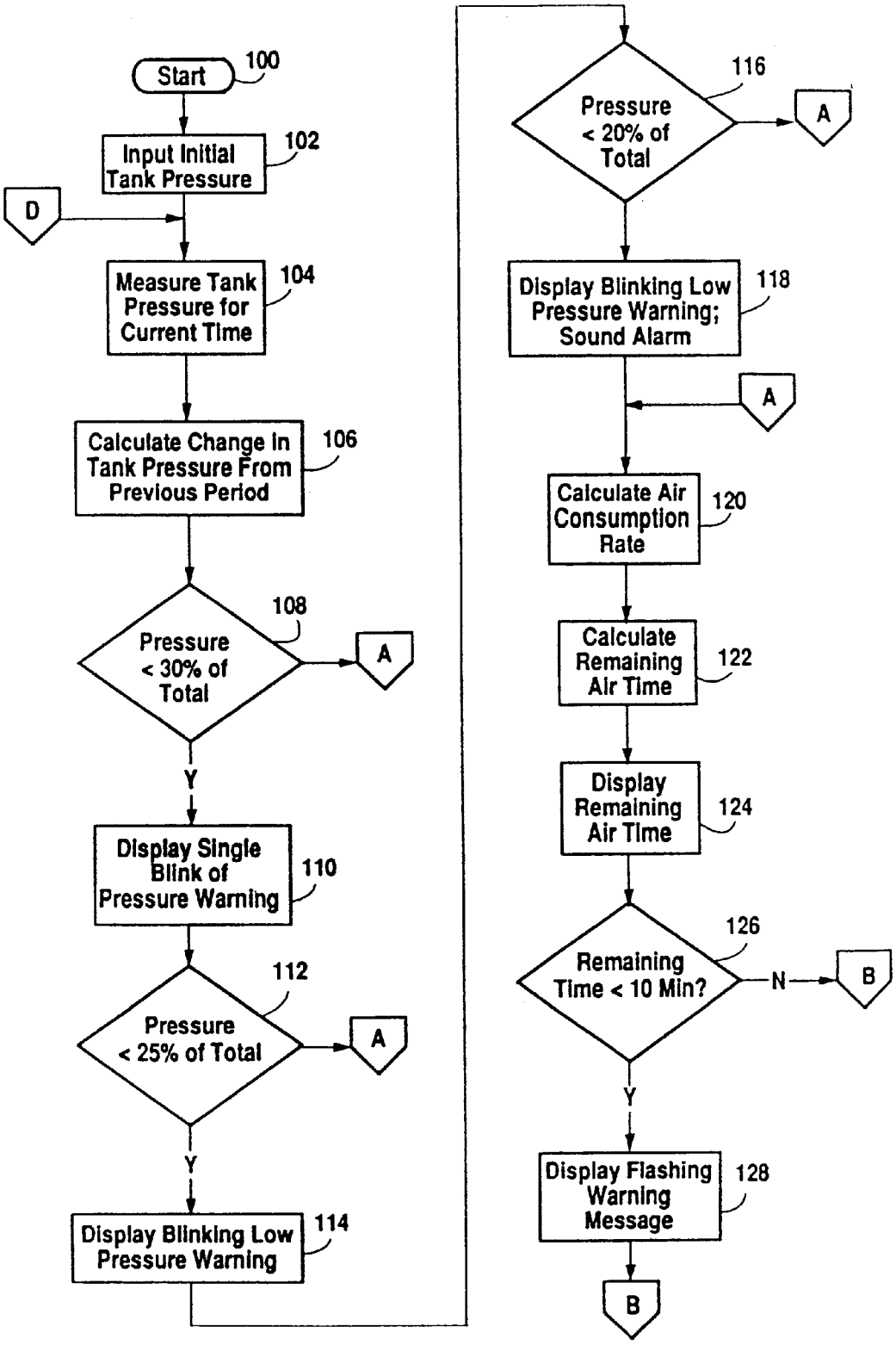
FIGS. 2A–2C comprise a flow chart of the data processing operations of microprocessor 12 of FIG. 1.
Figure 2B:
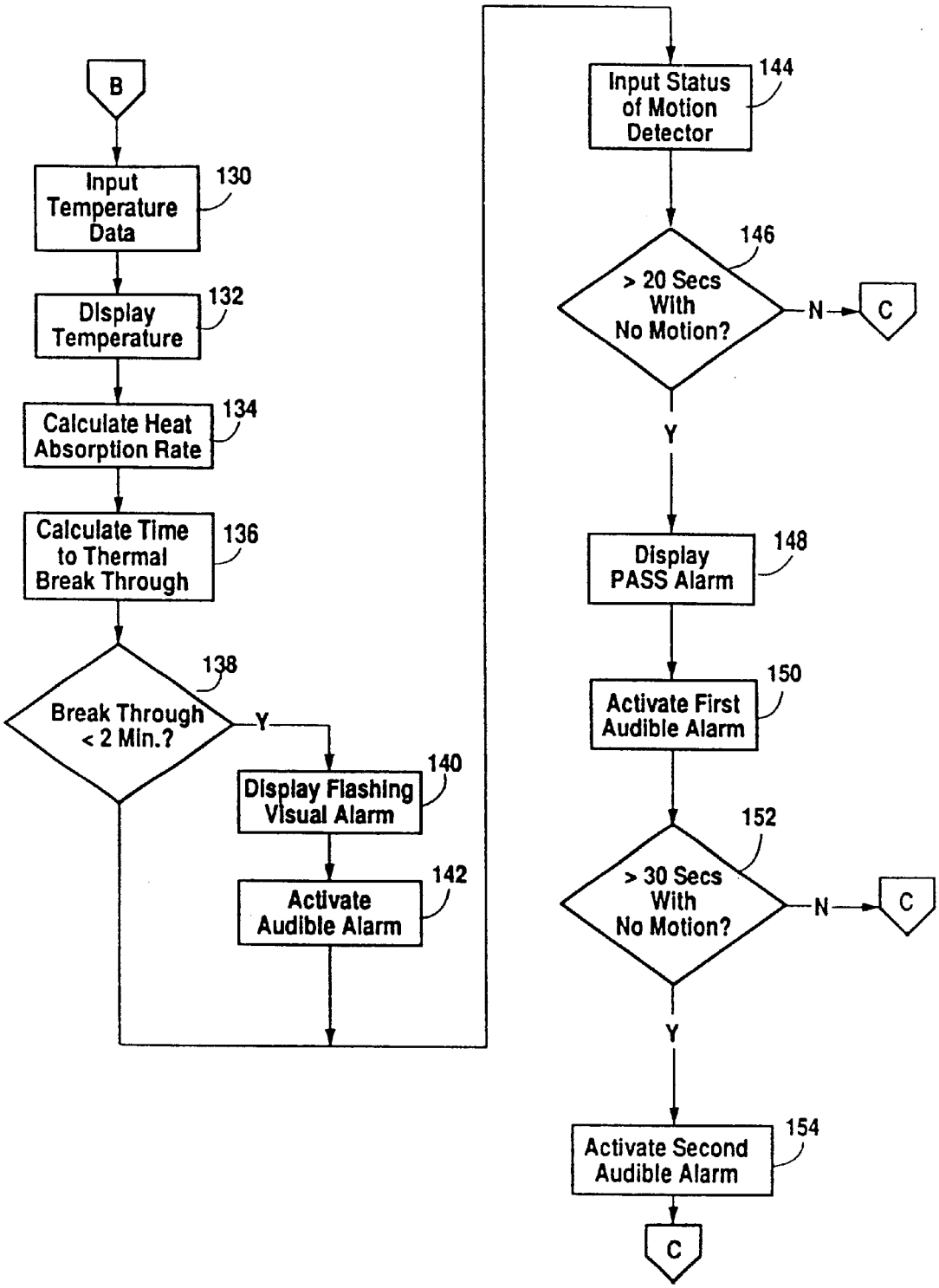
Figure 2C:
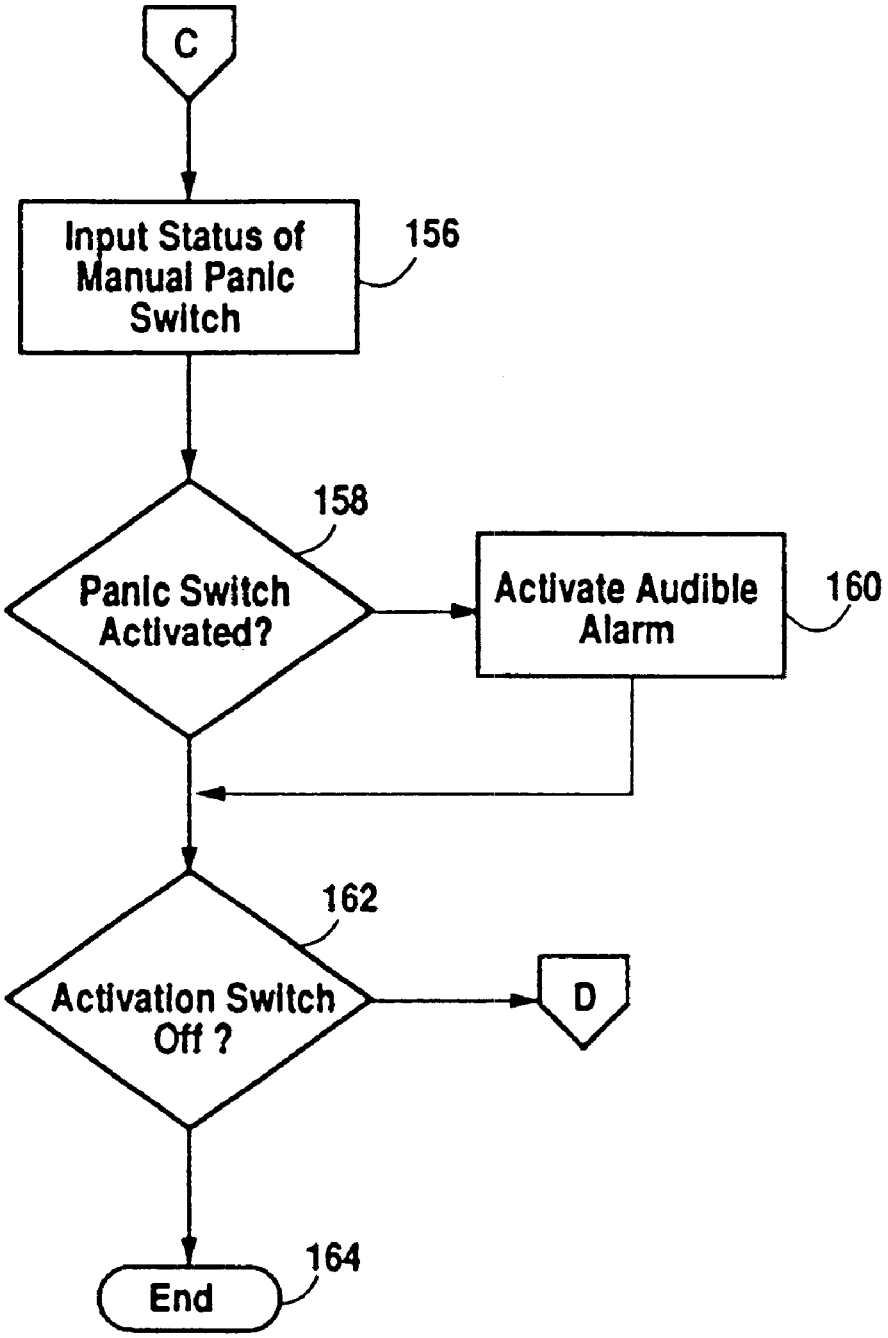

FIGS. 2*a*–2*c* are flow chart descriptions of the data processing steps followed by the microprocessor 12 in accordance with the algorithms contained in the program storage 14. In step 100 the microprocessor 12 is activated by a pneumatic signal provided by the pressure interface 22. In step 102, data regarding the initial tank pressure is received. In step 104, the current value of the tank pressure is determined and this pressure value is used, in step 106, to calculate the change in tank pressure from the previous time period. In step 108, the pressure value is tested to determine if the current pressure is less than 30 percent of the original tank pressure. If the result of this test is NO, the processing proceeds to step 120. However, if the test indicates that the pressure is less than 30 percent of the original volume, an advisory blink of the pressure indicator occurs on the LCD screen and the processing continues to step 112 to test whether the pressure is less than 25% of the original pressure. If the result of the test in step 112 is NO, the processing proceeds to step 120. However, if the test indicates that the current pressure is less than 25% of the original pressure, a blinking LOW PRESSURE message is displayed in step 114. The processing then proceeds to step 116 to test whether the current pressure is less than 20% of the original pressure. If the result of the test in step 116 is NO, the processing proceeds to step 120. However, if the test in step 116 indicates that the current pressure is less than 20% of the original pressure, an audible alarm is activated in step 118 to alert the user to the low tank pressure.

In step 120 the air consumption rate is calculated and the value is used to calculate the remaining air time in step 122. The remaining air time (RAT) is a computed projection of the time remaining till the tank pressure is zero. It is computed from the measured tank pressure divided by the rate of air consumption.

A direct measure of consumption rate is not available, therefore, the rate of consumption is computed from the change of air pressure divided by the time for that change.

$$RAT = \frac{\text{tank pressure}}{\text{consumption rate}} = \text{tank pressure} * \frac{\text{time}}{\text{change of pressure}}$$

The period over which the pressure change is measured is a compromise. The shorter the period, the greater the error and variation in computed RATs due to the intermittent nature of breathing and to the digital nature of the measured pressure. The longer the period, the slower the response to "real" rate changes. If the rate were determined by the pressure change in a fixed time selected for acceptable response, low rates would have large errors and variations. Instead, this device is measures the time for a fixed change to achieve better response at high consumption rates, while maintaining small errors and variations at all rates. The tradeoff is slow response at low consumption rates.

The system of the present invention employs 31 registers that store the time of each of the last 31 incremental changes of pressure. The increments of pressure are analog-to-digital converter resolution (presently, 1 part in 256 of full scale or about 10 psi for 2240 psi tanks). Time is recorded to a resolution of 1/16 second. Each time increment that the pressure does not fall below the "lowest previously recorded value," the first (newest) register is incremented. If the pressure falls below the lowest previously recorded value, the lowest previously recorded value is decremented and the values in the registers are shifted by one register toward the oldest register. The newest register is set to it's previous value incremented. For computational convenience, each time the registers are shifted, the value in the oldest register is subtracted from the values in each of the other registers. As a result the oldest register always holds a zero and the newest register contains the time for the last 30 increments of pressure change.

In step 124, the remaining air time is displayed on the LCD screen. A test is determined in step 126 to determine whether the remaining air time is less than 10 is minutes. If the result of the test in step 126 is YES, a low air time message is displayed on the LCD screen in step 128. However, if the result of the test is NO, the processing proceeds directly to step 130.

In step 130, the data regarding the ambient temperature is received and the temperature is displayed on the LCD screen in step 132. In step 134, the heat absorption rate for the fire fighter's suit is calculated. This information is then used in step 136 to calculate the remaining time before "thermal breakthrough." The time remaining until thermal breakthrough is proportional to a value determined by the reciprocal of the integral of the temperature above 200° F. In step 138, a test is performed to determine whether the time remaining before thermal breakthrough is less than 2 minutes. If the result of the test is NO, processing proceeds directly to step 144. However, if. the result of the test is YES, a visual high temperature alarm is displayed on the LCD screen in step 140 and an audible alarm is activated in step 142.

In step 144, data is received regarding the status of the motion detector. A test is performed in step 146 to determine whether more than 20 seconds have elapsed without detecting motion. If the result of this test is NO, the processing proceeds directly to step 156. However, if the result of the test in step 146 is YES, a PASS alarm is displayed on the screen in step 148 and a first audible alarm is activated in step 150. Another motion detection test is performed in step 152 to determine whether more than 30 seconds have elapsed without detecting motion. If the result of this test is NO, the processing proceeds directly to step 156. However, if the result of the test is YES, a second audible alarm is activated in step 154.

In step 156, data is received regarding the status of the manual panic switch and a test is performed in step 158 to determine whether the switch has been activated. If the result of the test is No, processing proceeds directly to step 162. However, if the result of the test is YES, an audible alarm is activated in step 160.

In step 162 a test is performed to determine whether the hardware switch has been deactivated to end processing of data. If the result of this test is YES, processing is ended in step 164. However, if the result of this test is NO, the system returns to step 104 to repeat the processing steps 104 through 162.

Figure 3:
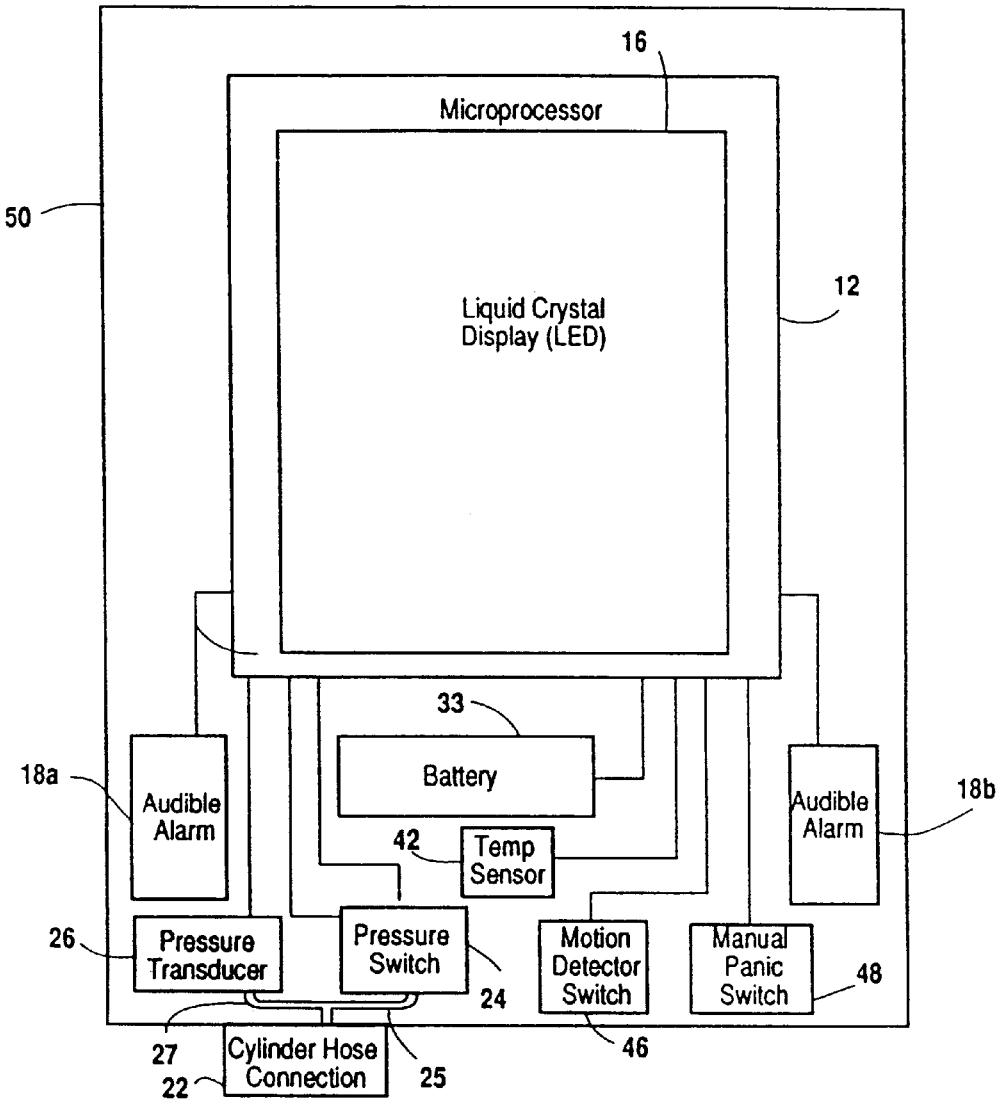
FIG. 3 is an illustration of the mounting of the components within the system case.
Figure 4:
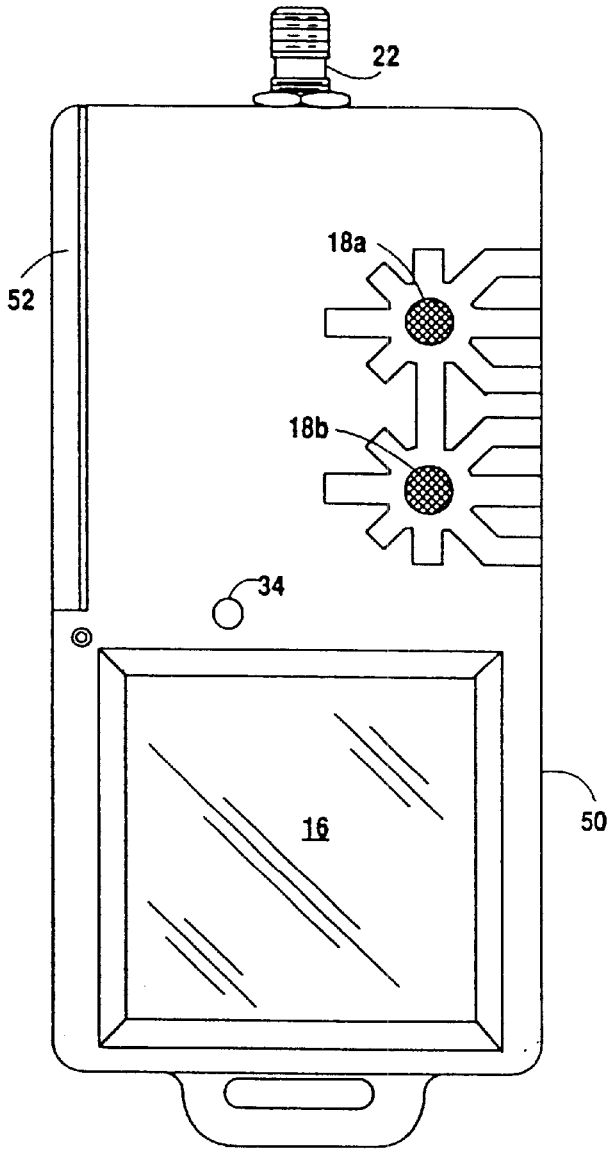
FIG. 4 is a plan view of the case for the firefighter's computer system of the present invention.
Figure 5:
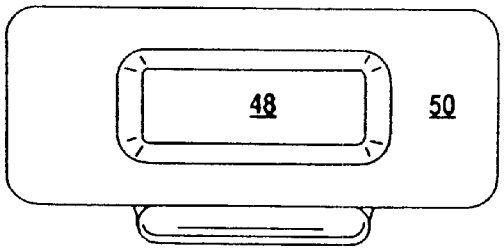
FIG. 5 is a top view of the case for the firefighter's computer system of the present invention.
Figure 6:
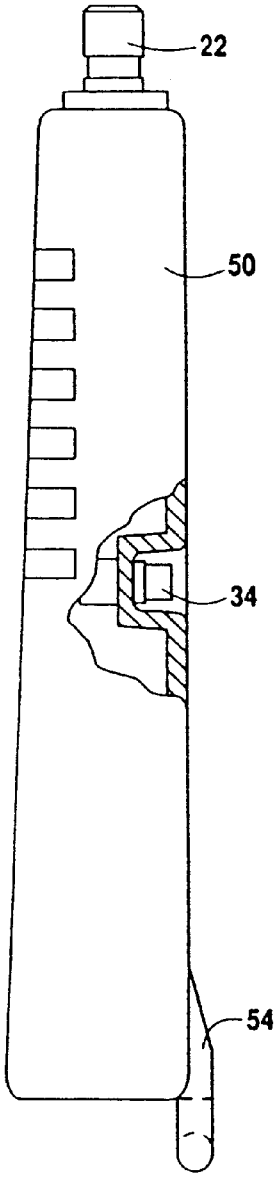
FIG. 6 is a side view of the case for the firefighter's computer system of the present invention.

Referring to FIGS. 3–5, the physical layout of the system components is shown within the case 50. The microprocessor 12, battery 33, and LCD 16 are mounted within a case 18, along with other components of the computer system discussed hereinbelow. Case 50 may be provided with a belt or mounting clip.

Referring again to FIGS. 3–5, the pressure monitoring apparatus utilized in connection with the computer system of the present invention comprises a self contained breathing apparatus interface connection 22 which is appropriately mounted to the case 50. Connection 22 is in fluid communication with a pressure switch 24 via a line 25. The pressure switch 24 is connected to the microprocessor 12 and is adapted to turn the microprocessor 12 and computer system ON when the firefighter's air supply is turned on. The connection 22 is also in fluid communication with a pressure transducer 26 via a line 27. The transducer 26 is connected to microprocessor 12.

Referring again to FIGS. 3–5, the temperature monitoring apparatus of the computer system comprises a temperature sensor 42 which is mounted near the exterior of the case 50 and connected to microprocessor 12.

Referring again to FIGS. 3–5, the personal alert safety system of the present invention comprises a pair of piezo buzzer alarms 18*a* and 18*b*, and a manual panic switch 48 and a motion detector switch 46, all of which are connected to microprocessor 12.

Referring to FIGS. 3–6, the computer system of the present invention is attached to a firefighter's air cylinder hose by connection 22 and automatically activates when the air is turned on. The system is turned OFF manually by a recessed push button switch 34. A pair of software switches (not shown) are mounted within battery compartment 52, the first of which indicates the particular rated tank pressure (2216 psi, 3000 psi, or 4500 psi) and the second of which indicates the rated capacity of the tank (30 minutes, 45 minutes, or 60 minutes). On activation of the system, the system automatically indicates what the computer is set to so that the firefighter can adjust if not correct.

During usage of the computer system, the microprocessor 12 works in conjunction with an analog to digital converter to measure the voltage generated by the pressure transducer 26. This voltage is proportional to cylinder pressure. By making a number of pressure readings over very precise time intervals, as discussed above, the microprocessor 12 determines the rate at which the firefighter is using his or her air supply. Thus, air pressure is displayed on the LCD 16 as total air supply and remaining air time. When the pressure of the firefighter's air cylinder reaches twenty five percent of its initial volume, the LCD 16 begins to blink. Further, when the remaining air time is ten minutes, the LCD 16 flashes "10 minutes."

The temperature sensor 42 is connected to microprocessor 12 and is utilized to display the actual air temperature on the LCD 16. Further, the microprocessor incorporates a time/temperature algorithm which takes into account the heat absorption rate of the insulated material worn by the firefighter. Two minutes prior to thermal "break through" an audible warning alarm of approximately seventy five decibels is sounded in addition to a flashing visual alarm on the LCD 16. An audible alarm of approximately ninety five decibels is sounded upon full thermal "break through."

The personal alert safety system of the present invention incorporates the manual panic switch 48 which is adapted to activate piezo buzzer alarms 18*a* and 18*b*. Further, the motion detector switch 44 comprises a mercury switch or piezo type switch for sensing the absence of motion. If there has been no motion for approximately twenty seconds, an audible alarm of approximately seventy five decibels will sound. If the firefighter has merely been standing still, the case or switch 46 may simply be shaken or moved so as to reset the switch 46. If no movement is detected for thirty seconds, an audible alarm of approximately ninety five decibels will sound.

Figure 7:
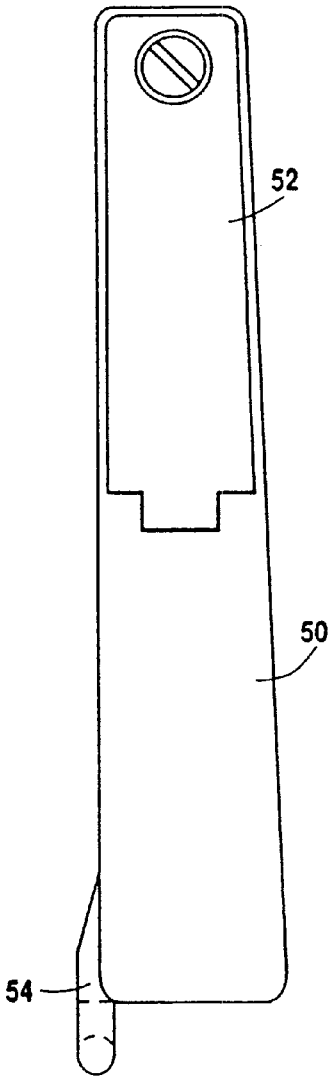
FIG. 7 is an opposite side view of the case for the firefighter's computer system of the present invention.
Figure 8:
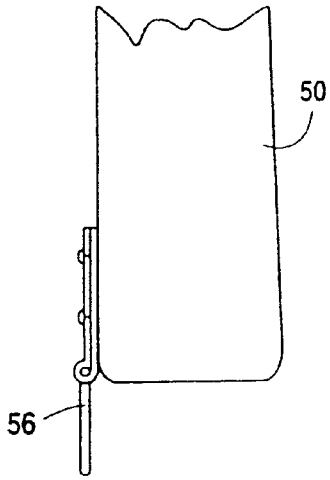
FIG. 8 is a partial side view of the case for the firefighter's computer system of the present invention.

Referring to FIG. 7 and FIG. 8 the case 50 may be provided with a molded plastic tether hook 54 connected thereto or, alternatively, a metal swivel B ring 56 which is riveted to case 50.

Figure 9:
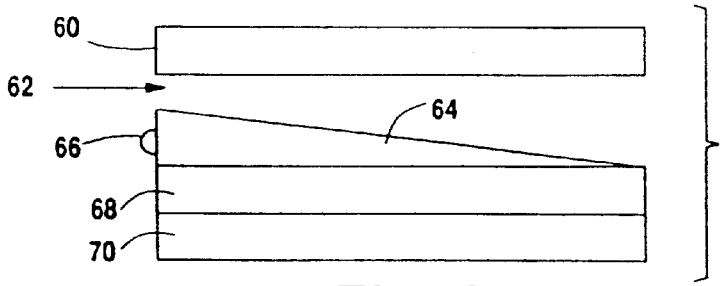
FIG. 9 is a sectional view of the wedge arrangement for the liquid crystal display utilized in the firefighter's computer system of the present invention.

Referring to FIG. 9, the wedge type LCD arrangement comprises an upper glass portion 60, a space 62, and a lighting wedge 64 having an LED 66 on one end thereof. The lighting wedge 64 is connected to an LCD 68 which, in turn, is connected to a phosphorescent backing 70.

While the firefighter's computer system of the present invention has been described in connection with the preferred embodiment, it is not intended to limit the invention to the particular form set forth, but on the contrary, it is intended to cover such alternatives, modifications, and equivalents, as may be included within the spirit and scope of the invention as defined by the appended claims.

We claim:

1. A method of providing electrical power to a microprocessor within a monitoring and alarm system used with self contained breathing apparatus, the method comprising coupling a pressure transducer to the breathing apparatus and the microprocessor;

supplying a continuous portion of electrical power to the microprocessor to monitor a signal indicative of transduced breathing apparatus pressure; and allowing an activating portion of electrical power to flow to the microprocessor for monitoring at least one signal in addition to said pressure signal when transduced breathing apparatus pressure exceeds a predetermined value.

2. A method of monitoring parameters associated with use of a self contained breathing apparatus, the method comprising:

providing electrical power to a microprocessor within a monitoring and alarm system according to the method of claim 1; and providing a visual display for transduced breathing apparatus pressure; and visually monitoring transduced breathing apparatus pressure processed for said display by said microprocessor.

3. A method of alarming on a dangerous condition associated with use of a self contained breathing apparatus, the method comprising:

supplying electrical power to a microprocessor within a monitoring and alarm system according to the method of claim 1; and providing an audible alarm for dangerously low transduced breathing apparatus pressure; and activating said alarm through said microprocessor when transduced breathing apparatus pressure falls below a predetermined level.

4. A method of alarming on a dangerous condition associated with use of a self contained breathing apparatus, the method comprising:

supplying electrical power to a microprocessor within a monitoring and alarm system according to the method of claim 1; and coupling a motion detector to said breathing apparatus;

activating said motion detector through said microprocessor; and providing an audible alarm indicative of dangerously insufficient detected motion.

5. A method of alarming on a dangerous condition associated with use of a self contained breathing apparatus, the method comprising:

supplying electrical power to a microprocessor within a monitoring and alarm system according to the method of claim 1;

coupling to said breathing apparatus a detector providing a signal which is a function of ambient temperature;

activating said temperature detector through said microprocessor; and providing an audible alarm indicative of dangerous temperatures.

6. An electrical power supply for a microprocessor in a monitoring and alarm system used with self contained breathing apparatus, the power supply comprising:

a microprocessor adapted to monitor a plurality of signals;

a pressure transducer coupled to the breathing apparatus and said microprocessor, said pressure transducer comprising an analog-to-digital converter and producing a digital pressure signal indicative of breathing apparatus pressure;

a battery supplying continuous electrical power to said microprocessor for monitoring said digital pressure signal; and a switch allowing electrical power to flow to said microprocessor at a transduced pressure above a predetermined value for monitoring at least one additional signal.

7. A monitoring and alarm system used with self contained breathing apparatus, said system comprising:

an electrical power supply according to claim 6;

a visual alarm for dangerously low transduced breathing apparatus pressure, said visual alarm being activated through said microprocessor; and a visual display for monitoring transduced breathing apparatus pressure, said visual display being activated through said microprocessor.

8. The monitoring and alarm system of claim 7 additionally comprising an audible pressure alarm for dangerously low transduced breathing apparatus pressure, said audible pressure alarm being activated through said microprocessor.

9. The monitoring and alarm system of claim 8 additionally comprising a motion detector producing a signal indicative of motion of said monitoring and alarm system, and further comprising an audible motion alarm for dangerously insufficient detected motion, said audible motion alarm being activated through said microprocessor.

10. The monitoring and alarm system of claim 9 additionally comprising a temperature detector and an audible temperature alarm, said temperature detector producing a signal which is a function of ambient temperature, and said audible temperature alarm being activated through said microprocessor to warn of dangerous temperatures.

11. A method of conserving electrical power in a monitoring and alarm system used with self contained breathing apparatus, the method comprising:

providing for unswitched delivery of a continuous portion of electrical power to the monitoring and alarm system;

providing for switched delivery of an activating portion of electrical power to the monitoring and alarm system;

monitoring pressure in the breathing apparatus using said continuous portion of electrical power; and switching on said activating portion of electrical power to monitor at least one additional parameter associated with use of the breathing apparatus when pressure in the breathing apparatus exceeds a predetermined value.

12. The method of claim 11 wherein said at least one additional parameter comprises detected motion.

13. The method of claim 11 wherein said at least one additional parameter comprises ambient temperature as a function of time.

14. A method of conserving electrical power in a monitoring and alarm system used with self contained breathing apparatus, the method comprising:

providing for unswitched delivery of a continuous portion of electrical power to the monitoring and alarm system;

providing for switched delivery of an activating portion of electrical power to the monitoring and alarm system;

intermittently monitoring pressure in the breathing apparatus using said continuous portion of electrical power; and switching on said activating portion of electrical power to monitor at least one additional parameter associated with use of the breathing apparatus when pressure in the breathing apparatus exceeds a predetermined value.

15. The method of claim 14 wherein said at least one additional parameter comprises detected motion.

16. The method of claim 14 wherein said at least one additional parameter comprises ambient temperature as a function of time.

* * * * *